United States Patent [19]

McGee

[11] 4,383,560

[45] May 17, 1983

[54] LATHE CHARGER HAVING DIRECTIONALLY LIMITED ADJUSTMENT OF SCANNING SPINDLES

[75] Inventor: Arthur L. McGee, Lake Oswego, Oreg.

[73] Assignee: The Coe Manufacturing Company, Painesville, Ohio

[21] Appl. No.: 208,638

[22] Filed: Nov. 20, 1980

Related U.S. Application Data

[63] Continuation-in-part of Ser. No. 154,201, May 29, 1980, Pat. No. 4,335,763.

[51] Int. Cl.[3] ..... B27L 5/02

[52] U.S. Cl. ..... 144/209 A; 82/45; 250/560; 356/384

[58] Field of Search ..... 144/209 R, 209 A; 82/45, 25; 364/556, 564; 356/387, 384, 386; 250/560

[56] References Cited

U.S. PATENT DOCUMENTS

| | | | |
|---|---|---|---|
| 3,392,765 | 7/1968 | Brookhyser et al. | 144/209 |
| 3,752,201 | 8/1973 | Heth | 144/209 A |
| 3,852,579 | 12/1974 | Sohn et al. | 235/151.3 |
| 4,197,888 | 4/1980 | McGee et al. | 144/209 |
| 4,335,763 | 6/1982 | McGee | 144/209 A |

*Primary Examiner*—W. D. Bray
*Attorney, Agent, or Firm*—Klarquist, Sparkman, Campbell, Leigh, Whinston & Dellett

[57] ABSTRACT

A veneer lathe charger apparatus is disclosed for scanning a rotating log with light to determine its optimum yield axis and adjusting the charger spindles through a greater range necessary for large diameter logs to position such axis at a predetermined transfer position. The log is rough centered with its longitudinal axis at a scanning position by rough centering arms which are released prior to scanning. After scanning the log is moved from its scanning position to align such optimum yield axis with a predetermined transfer position axis where it is engaged by a transfer clamp means for movement to a lathe axis position without reclamping by such centering arms. A spindle support and adjustment means is provided for adjusting the charger spindles to move the optimum yield axis of the log to the transfer position axis. A control means enables directionally limited adjustment of the charger spindles a greater distance away from the transfer clamp means than toward such clamp means. The control means causes the charger spindle means to rotate the log into a different rotational position after scanning in order to enable to spindle support and adjustment means to move the log through its greatest adjustment in a direction other than towards the clamp means. This directionally limited adjustment of the scanning spindles enables the transfer clamp means to clear the spindles when such transfer means moves from the lathe position to the transfer position prior to engagement of the log and to engage the ends of the log while the charger spindles are still engaged, thereby eliminating any need to reclamp the side of the log with the rough centering arms.

18 Claims, 8 Drawing Figures

FIG. 7
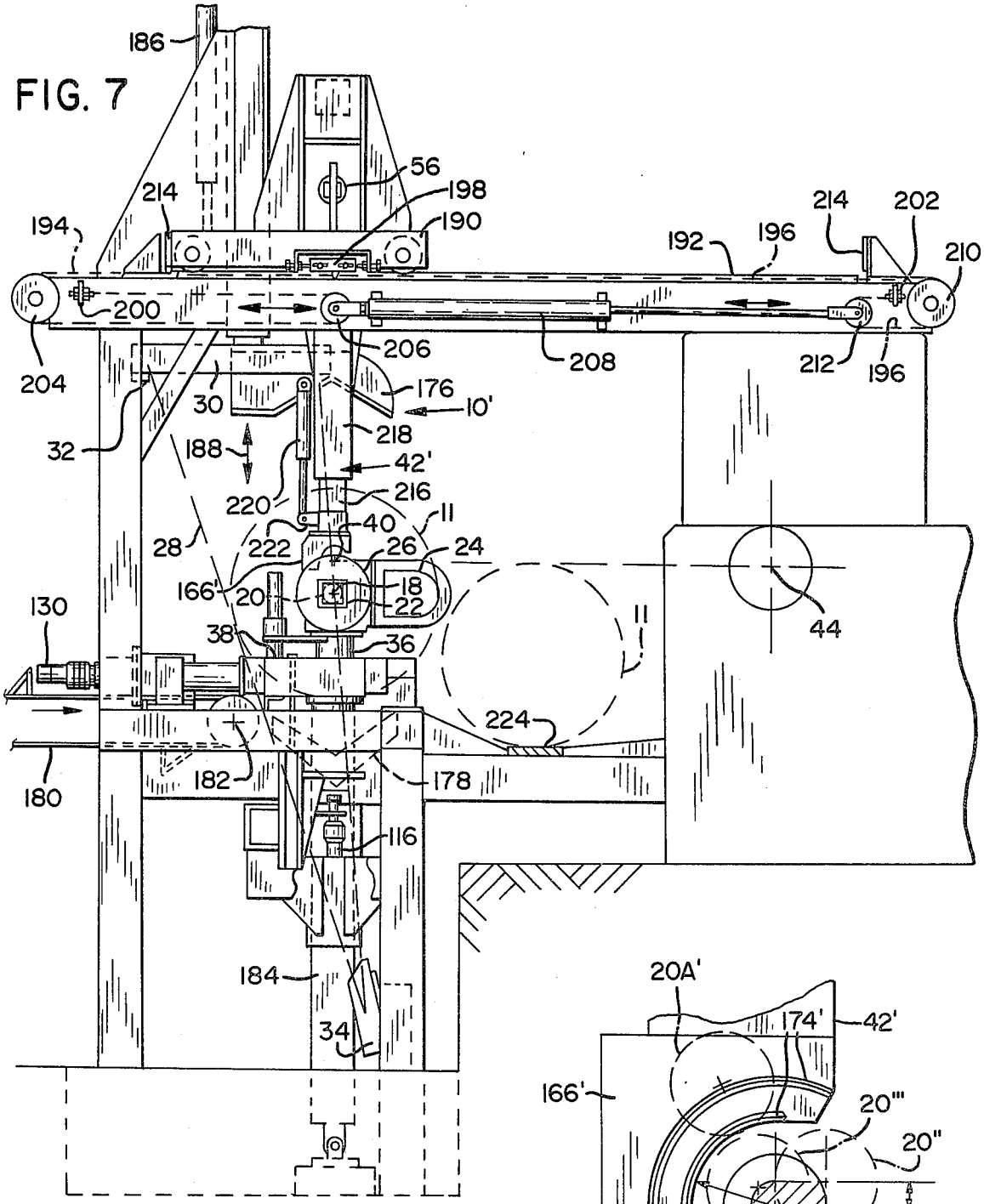
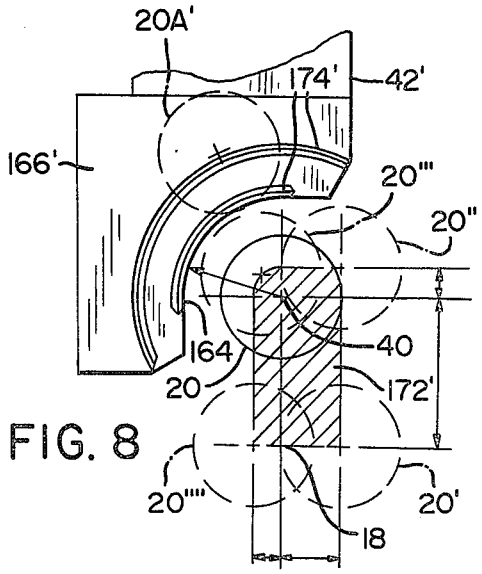
FIG. 8

LATHE CHARGER HAVING DIRECTIONALLY LIMITED ADJUSTMENT OF SCANNING SPINDLES

REFERENCE TO RELATED APPLICATION

The present application is a continuation-in-part of pending U.S. patent application, Ser. No. 06/154,201 filed May 29, 1980 by Arthur L. McGee entitled "Veneer Lathe Charger Having Improved Positioning for Charger Spindles" now U.S. Pat. No. 4,335,763.

BACKGROUND OF INVENTION

The subject matter of the present invention relates generally to log processing apparatus and, in particular to veneer lathe chargers of the type which rough center the log in a scan position, rotate the log while scanning such log with light or other electromagnetic radiation to determine its optimum yield axis, adjust the position of the charger spindles to align such optimum yield axis in a predetermined transfer position, and transfer the log from such transfer position to the lathe axis. The lathe charger apparatus of the present invention accomplishes such adjustment of the charger spindles over a greater range necessary for logs of larger diameter and enables engagement of the opposite ends of such log by transfer clamp means while the spindles still engage the log, thereby eliminating any need to reclamp the side of the log with rough centering arms after scanning. The lathe charger apparatus of the present invention provides sufficient clearance to enable the transfer clamp means to move from contact with a previous log in the lathe spindle position to the transfer position for engagement with the next log while the charger spindles are still engaged with the ends of such next log. This is made possible by providing directionally limited adjustment of the charger spindles to move the optimum yield axis of the log into the transfer position after scanning to determine such optimum yield axis. This directionally limited adjustment of the log is accomplished by an automatic control means which rotates the log to a different rotational position after scanning to enable the log to be moved through its greatest adjustment in a direction other than toward the transfer clamp means in the transfer position. In addition, the charger spindle support and adjustment means is adapted to move the charger spindle means away from the transfer clamp means a greater distance than toward such clamp means. In this regard a stop means can be employed to prevent the charger spindles from being moved into a position of interference contact with the transfer clamp means as the latter is moved from the lathe spindle position to the transfer position.

The lathe charger apparatus of the present invention is an improvement on my earlier light scanning lathe charger disclosed in U.S. Pat. No. 4,197,888. This earlier lathe charger required that the log be reclamped by the rough centering arms after scanning and the charger scanning spindles disengaged from the ends of the log to provide sufficient clearance for the transfer clamp arms to swing past such spindles and engage the ends of a log. In order to attempt to avoid this need for reclamping of the log by the rough centering arms, a second embodiment is shown in FIG. 11 of such patent employing a special transfer clamp arm with a pivotally mounted clamp end portion operated by a cylinder. However, this solution is complicated and expensive.

In my earlier U.S. patent application Ser. No. 06/154,201, a lathe charger is disclosed which eliminates the need to reclamp the log by the rough centering arms and provides sufficient clearance for the transfer clamp means by locating the charger spindles at a scanning position which is spaced a predetermined distance below the transfer position axis. This enables the transfer clamp arms to move from the lathe spindle position to the transfer position while the log is in the scanning position and thereafter moving the log upward from the scanning position until its optimum yield axis is positioned in alignment with the transfer position axis by adjustment of the charger spindles. Then the transfer clamp means is moved into engagement with the ends of the log and the charger spindles are retracted to provide sufficient clearance for the transfer clamp arms to move from the transfer position back to the lathe axis position. Unfortunately, the maximum adjustment of the position of the charger spindles is somewhat limited in such charger, being only $\pm 1.5$ inches from the center of an ideal circular cylinder. As a result, large diameter logs requiring more than 1.5 inch adjustment between the rough geometric center and the optimum yield axis, cannot be correctly positioned.

In my earlier U.S. Pat. No. 4,197,888 a lathe charger apparatus is disclosed in which the optimum yield axis of a log is determined by light scanning such log. Light beams are directed past the side of the log through the space between such log and a reference edge to project an image of such space onto photoelectric detectors at longitudinally spaced positions while the log is rotated on charger spindles. The output signals of such detectors are fed to a computer which determines the optimum veneer yield axis of such log. After such scanning, the charger spindles are adjusted horizontally and vertically to position the optimum yield axis of the log at a transfer position axis located at a predetermined position relative to the lathe spindle axis. Transfer clamp arms engage the ends of the log and move such log from the transfer position to the lathe axis. This positioning of the log is accomplished automatically by means of the computer control system shown in FIG. 9 of such patent. A similar computer control system is employed in the present invention to determine the optimum yield axis of the log and to adjust the position of the charger spindles. However, in the present invention the computer is programmed to provide directionally limited adjustment of the charger spindles so that the maximum adjustment of the log is in a direction other than toward the transfer clamp arms when its optimum yield axis is aligned with the transfer position axis.

Other scanning techniques can be employed to determine the optimum yield axis including the light reflection technique shown in U.S. Pat. No. 3,852,579 of Sohn et al. In addition, other electromagnetic radiation other than light can be employed during scanning, such as microwaves. Therefore, the present invention is not limited to light beam scanning of the type shown in U.S. Pat. No. 4,197,888 to determine the optimum yield axis.

As a result of eliminating the need to reclamp the side of the log with the rough centering arms after scanning or to disengage the charge spindles before engagement by the transfer clamp means, the lathe charger apparatus of the present invention is considerably simplified and faster operating. Thus, the rough centering arms can move to receive a new log during scanning rotation of the previous log to determine its optimum yield axis and adjustment of the charger spindles holding the previous log to align such optimum yield axis with the transfer position axis. Also, the transfer clamp arms or other transfer clamp means can return immediately from the lathe axis position back to the transfer position and do not have to wait for reclamping of the next log or disengagement of the charger scanning spindles from such next log before reclamping. Finally, by employing directionally limited adjustment of the charger spindles to align the optimum yield axis of the log in the transfer position a greater range of adjustment is achieved. The result is a faster and more efficient lathe charger operation by an apparatus which is capable of properly adjusting the optimum yield axis of the logs of larger diameter.

SUMMARY OF THE INVENTION

It is therefore one object of the present invention to provide an improved log processing apparatus of simplier construction and faster operation which scans the log to determine its optimum yield axis and adjusts the scanning spindles over a greater range to align such optimum yield axis with a predetermined transfer position axis so that it is capable of properly positioning logs of larger diameter.

Another object of the invention is to provide such a log processing apparatus in which the charging spindles are moved to align the optimum yield axis of the log with the transfer position axis in a manner which enables the transfer clamp means to move from a work position to the transfer position and to engage the ends of the log in such transfer position without disengaging the scanning spindles and without reclamping the side of the log with the rough centering arms.

A further object of the present invention is to provide such a log processing apparatus with directionally limited adjustment of the scanning spindles to align the optimum yield axis of the log with the transfer position axis and thereby provide a greater range of adjustments for such spindles.

An additional object of the invention is to provide such a log processing apparatus in which the log is rotated into a different position after scanning to enable the scanning spindles to be adjusted through its greatest adjustment in a direction other than toward a transfer clamp means, thereby providing sufficient clearance between the spindles and the transfer clamp means so that such spindles do not have to be disengaged when such clamp means moves from the work position to the transfer position.

Still another object of the invention is to provide such log processing apparatus as a veneer lathe charger apparatus for scanning a log while rotating such log about charger spindles to determine its optimum yield axis, adjusting the position of the log by movement of the charger spindles to align such optimum yield axis with a transfer position axis, and transferring the log from such transfer position to a lathe axis position in a fast, accurate and inexpensive manner and over a greater range of adjustment to properly position logs of larger diameter.

A still further object of the present invention is to provide such a lathe charger apparatus in which the scan position is spaced from the transfer position by an amount sufficient to enable the transfer clamp means to clear the charger spindles when such clamp means returns from a lathe axis position to the transfer position, and in which adjustment of the charger spindles is directionally limited to an angular range of about 90 degrees as the optimum yield axis is aligned with the transfer position axis.

A still additional object of the invention is to provide such a lathe charger apparatus which is provided with directionally limited adjustment of the charger spindles including stop means for preventing the charger spindles from being moved toward the transfer clamp means beyond a predetermined limit in such transfer position.

A still further object of the invention is to provide such a lathe charger apparatus in which adjustment of the charger spindle means is limited to an angular range of about 180 degrees in the transfer position and prevents movement of such spindle means toward the transfer clamp means in such transfer position.

Other objects and advantages of the present invention will be apparent from the following detailed description of preferred embodiments thereof and from the attached drawings.

DRAWINGS

FIG. 7 is a side elevation view of another embodiment of the lathe charger apparatus of the invention;

FIG. 8 is an enlarged view of the transfer clamp arm and lathe spindle in the apparatus of FIG. 7 showing adjustment of the spindle position in accordance with another embodiment of the invention.

DESCRIPTION OF PREFERRED EMBODIMENT

Figure 1:
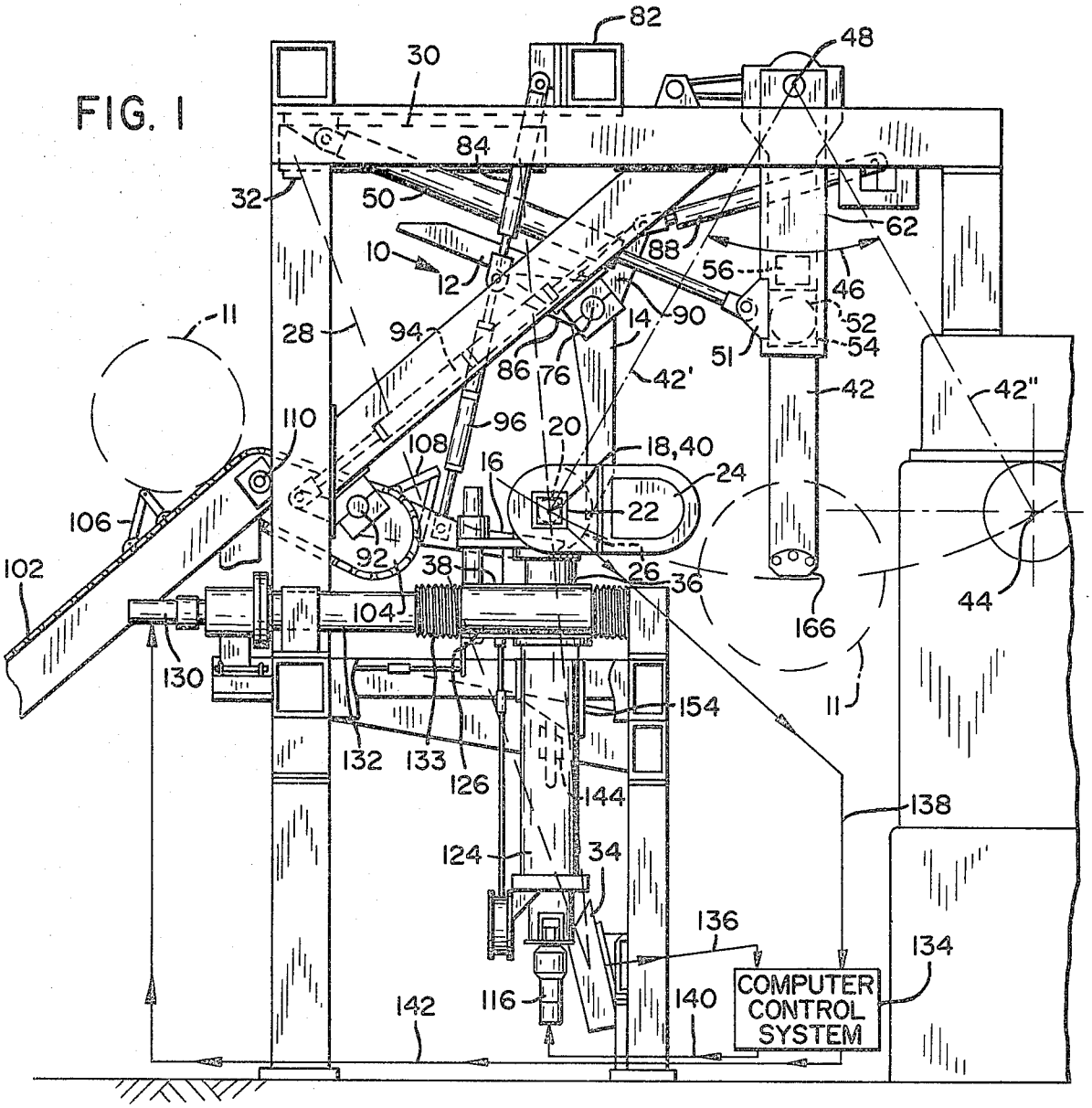
FIG. 1 is a side elevation view of one embodiment of the veneer lathe charger apparatus of the present invention.
Figure 2:
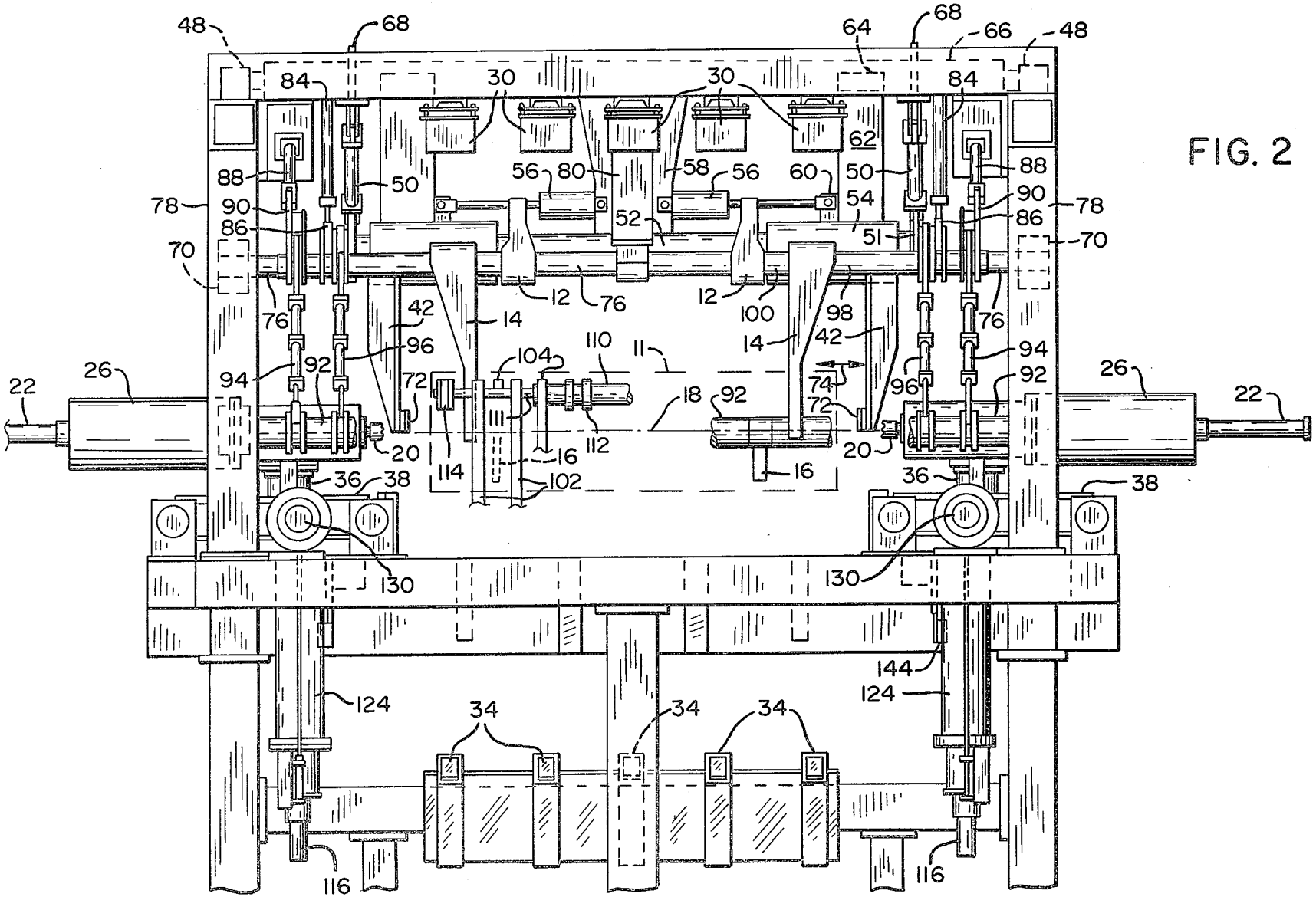
FIG. 2 is a front elevation view of the apparatus of FIG. 1.

As shown in FIGS. 1 and 2, one embodiment of the veneer lathe charger apparatus of the present invention includes a log support and rough centering means 10 comprising three centering arms 12, 14 and 16 which support and center a log 11 by clamping the sides of such log so its longitudinal axis is roughly centered at a scan position axis 18. The rough centering arms 12, 14 and 16 operate in the manner described in U.S. Pat. No. 3,392,765 of B. Brookhyser et al. issued July 16, 1968. The log is engaged by charger spindles 20 at the opposite ends thereof which are urged into contact with such log by spindle cylinders 22 whose piston rods are coupled to the spindle shaft, as shown in FIG. 2. The charger spindles are rotated about the scanning axis 18 by a spindle motor 24 connected through coupling belts or other means within a housing 26. A light beam 28 emitted from each of a plurality of light sources 30 is transmitted through the space between a reference edge member 32 adjacent such light source and the side of the log to a plurality of light detectors 34 spaced longitudinally along the log. The light detector may be in the form of a television camera having a linear array of PN junction semiconductor photocells.

The rotating log is scanned by the light beams to determine the optimum yield axis of the log in the manner described in my earlier U.S. Pat. No. 4,197,888. Thus, the light detector cameras 34 produce electrical output signals corresponding to the log diameters at different rotational positions of the log and such output signals are fed to a microprocessor to determine the optimum yield axis for such log when it is peeled in a veneer lathe as shown in FIGS. 8 and 9 of U.S. Pat. No. 4,197,888.

The lathe spindle housing 26 is mounted on a vertical adjustment support 36 which in turn is mounted on a horizontal adjustment support 38 for horizontal and vertical adjustment of the lathe spindles 20 in two mutually perpendicular directions. The spindle support and adjustment means 36 and 38 align the optimum yield axis of the log with a transfer position axis 40 which corresponds to the scan axis 18 in this embodiment of the invention. It should be noted that when, in the unlikely event, the computer determined optimum yield axis of the log corresponds exactly to the mechanically determined rough center axis of the log which in the scan position is aligned with the scanning axis 18, no horizontal and vertical adjustment of the log is required. However, in most cases the optimum yield axis is spaced from the rough center axis so that after scanning the charger spindles 20 must be adjusted from alignment with the scanning position axis 18 in order to position the optimum yield axis in alignment with the transfer position axis 40. In the first embodiment shown in FIGS. 1 to 6 the transfer position axis 40 also corresponds to the scan position axis 18. However this is not true of the second embodiment shown in FIGS. 7 and 8.

After the log is positioned with its optimum yield axis in alignment with the transfer position axis 40, a pair of transfer clamp arms 42 are moved into engagement with the opposite ends of the log while the spindles 20 still engage such log, thereby eliminating any need to reclamp the sides of the log with the rough centering arms 12, 14 and 16. After release of the charger spindles 20 the log is moved by the transfer arms 42 from the transfer position 40 to a work position at the veneer lathe axis 44 where the optimum yield axis of the log is aligned with a lathe spindle axis. The transfer clamp arms 42 pivot, as shown by the double-headed arrow 46, about a mounting beam bearing 48 at the top of such arms through an angle of approximately 60 degrees when moving back and forth between the transfer position axis 40 and the lathe spindle axis position 44. The transfer clamp arms 42 are caused to pivot about beam 48 by two transfer cylinders 50 whose piston rods are pivotally attached to a flange 51 on a support beam 52 to which the clamp arms are mounted by sliding members 54. The sliding members 54 and the transfer clamp arms 42 attached thereto are caused to slide longitudinally along beam 52 in response to the operation of a pair of clamp cylinders 56 attached between a beam hanger support 58 and a flange 60 welded to the slide member 54 as shown in FIG. 2.

The sliding support member 54 supporting the transfer clamp arm 42, is rigidly attached to a pendulum arm 62 whose upper end is slidably secured by bearings 64 to a main support beam 66 which rotates about the bearing 48. The opposite ends of the transfer clamp beam 52 are supported by hanger plates 68 on support beam 66. The piston rod of each of the two transfer cylinders 50 is connected to the flange 51 on beam 52 for pivoting such beam and the transfer clamp arm 42 about pivot 48, as shown in FIG. 2. The transfer clamp arms 42 have clamp end portions 72 which engage the opposite ends of the log 11 to clamp such log therebetween when the clamp cylinders 56 are operated to move such transfer clamp arms together in the direction of the double-headed arrow 74.

The rough centering means 10 includes a support beam 76 on which the clamp arms 12 and 14 are pivotally mounted. The opposite ends of such beam are fixedly secured at mountings 70 to vertical frame members 78 and an intermediate hanger support 80 secures such beam to an upper frame member 82. As shown in FIG. 2, a top centering cylinder 84 is attached to a flange member 86 which is connected by sleeve 98 to clamp arm 14 for rotating such clamp arm about the beam 76. Similarly, a pressure cylinder 88 is attached to a flange 90 which is connected by an inner sleeve 100 to the pressure clamp arm 12 in order to rotate such clamp arm about the beam 76. Sleeve 100 is positioned around beam 76 and inside sleeve 98 so that such sleeves are pivoted independently of each other. The lower centering arm 16 is mounted on another support beam 92 and is connected to the other two clamp arms 12 and 14 for movement therewith by a slip link cylinder 94 and a fixed link 96, respectively, which couple the rough centering clamp arms together in the manner described in U.S. Pat. No. 3,392,765 of Brookhyser.

As shown in FIG. 1, the logs 11 are loaded into the rough centering means 10 including centering arms 12, 14 and 16, by two sets of conveyor chains 102 and 104. The longer, log lifting conveyor 102 is a chair lift type conveyor chain having lugs or chairs 106 attached thereto which engage the logs and move them up an incline. Once the logs reach the top of the incline on conveyor 102 they are transferred onto the short, log lowering conveyor 104 from lugs 106 directly into engagement with the single chain lug 108 on such second conveyor. The weight of the log moves the second conveyor downward at the time of transfer so that such log is always in contact with one of the lugs 106 or 108. The second conveyor 104 is intermittently driven independently from the first conveyor 102. Thus, conveyor 104 is initially stopped so that the chair lug 108 is set in a rest position to engage the log 11 immediately after it rolls off of conveyor 102. Then the second conveyor 104 is energized to slowly lower the log downward until it engages the lower centering arm 16. At this point, the rough centering means 10 operates to clamp the log between the centering arms 12, 14 and 16 and roughly center it so that its longitudinal axis is in alignment with the scanning axis 18. As shown in FIG. 2, the log lowering conveyor 104 and the log lifting conveyor 102 are mounted on concentric support shafts 110 and 111, and are driven independently by separate hydraulic motors (not shown) through drive couplings 112 and 114, respectively.

Figure 3:
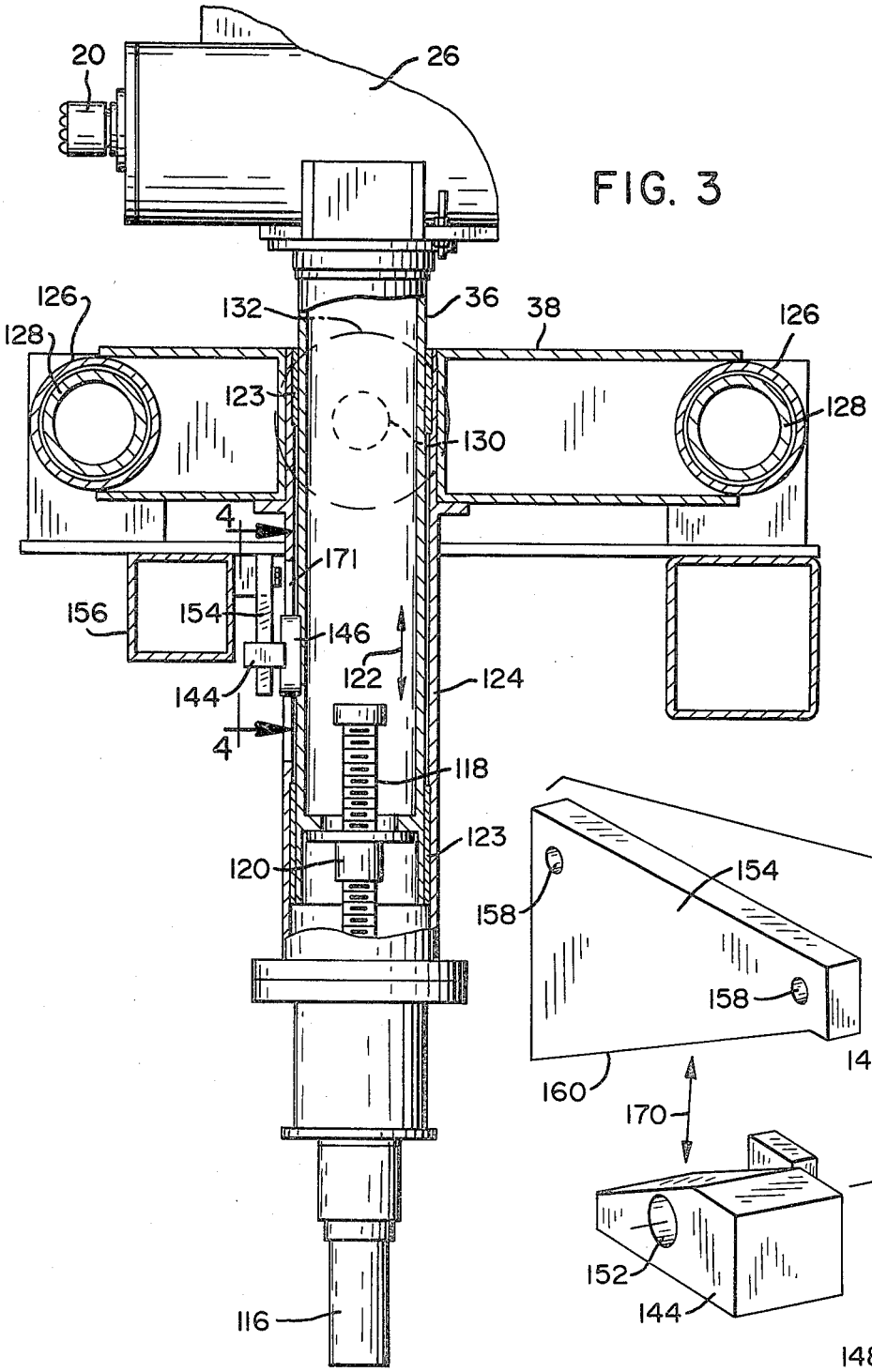
FIG. 3 is an enlarged view of a portion of FIG. 2 with parts broken away for clarity.

The charger spindle support and adjustment means including the vertical adjustment support 36 and the horizontal adjustment support 38 is shown in FIG. 3 and operates in a manner similar to that described in U.S. Pat. No. 4,197,888. A vertical drive step motor 116 whose output shaft is connected to a drive screw 118 which threadly engages a coupling member 120 fixedly attached to the tubular vertical support 36, moves such vertical support up and down in the direction of arrow 122. The vertical adjustment tube 36 is mounted for sliding movement on plastic bearing sleeves 123 inside a housing 124 which is mounted on the horizontal adjustment support member 38 for movement therewith. The horizontal adjustment member 38 is provided with a pair of guide tubes 126 which slide along horizontal guide beams 128. A similar horizontal adjustment drive means is provided including a horizontal drive step motor 130 and a screw drive coupled to the output shaft of such motor is enclosed in housing 132 including sealing bellows 133 connected to the ends of tubes 126, as shown in FIG. 1.

The vertical adjustment motor 116 and the horizontal adjustment motor 130 are controlled by the outputs of a digital computer control system 134 of the type shown in FIGS. 8 and 9 of my previous U.S. Pat. No. 4,197,888. Such computer control system has a light detector input 136 from each of the five light detector cameras 34 of FIG. 2 and has a shaft encoder input 138 connected to a shaft encoder attached to the shaft of the charger spindles 20. Such shaft encoder produces a digital output signal which indicates the rotational position of the spindle shaft when each camera signal is produced. The computer control system provides a vertical adjustment signal at output 140 to the step motor 116 which moves the vertical adjustment support 36 to position the charger spindle 20 in a vertical direction. Similarly, a horizontal adjustment signal at output 142 of the computer system is applied to step motor 130 in order to move the horizontal adjustment support 38 to properly position the charger spindle 20 in the horizontal direction. As a result of this adjustment horizontal and vertical movement of the charger spindles 20 at opposite ends of the log by motors 116 and 130, the optimum yield axis of the log as determined by the computer control system 134, is positioned in alignment with the transfer position axis 40.

Figure 4:
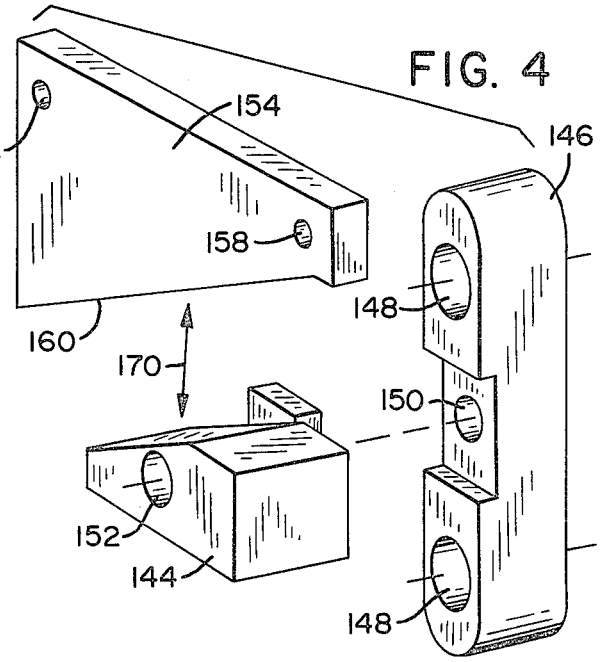
FIG. 4 is a further enlarged and exploded perspective view taken along the line 4—4 of FIG. 3.

As shown in FIGS. 3 and 4, a stop 144 is attached to the vertical adjustment member 36 by a stop support member 146 which is fastened thereto by bolts extending through bolt openings 148 in the ends of such support and bolt openings 150 and 151 in the middle of such support and such stop. A stop engaging member 154 is bolted to a fixed frame member 156 through bolt openings 158. The stop 144 engages the sloped bottom surface 160 of the stop engaging member 154 to limit further upward movement of the vertical adjust member 36 thereby preventing further movement of the charger spindle 20 toward the transfer clamp arm 42 in the manner shown in FIG. 5 and hereafter described.

Figure 5:
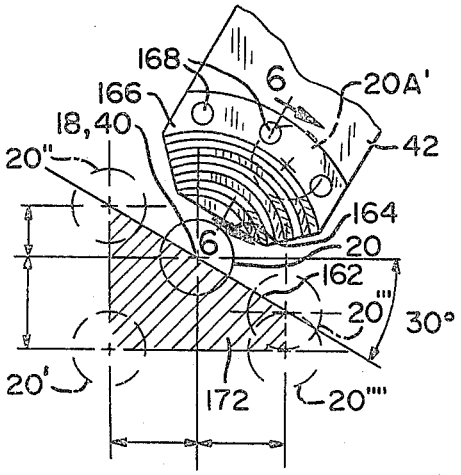
FIG. 5 is an enlarged view of the transfer clamp arm and charger spindle in the apparatus of FIGS. 1 to 4 showing adjustment of the spindle position in accordance with one embodiment of the invention.

The stop engaging member 154 is fixed to the frame 156 while the stop member 144 and attached vertical adjustment member 36 move vertically and also horizontally with horizontal adjustment member 38 along guide beams 128. As a result, the stop member 144 engages the stop surface 160 at different positions along such surface which allows vertical height changes in different horizontal positions of the stop member. As shown in FIG. 5, the maximum vertical height position of the charger spindle 20 varies along a vertical limit line 162 extending diagonally at a 30 degree angle to the horizontal and which is parallel to and spaced from the straight end surface 164 of a clamp end portion 166 fastened to the transfer clamp arm 42 by bolts at openings 168. Thus, the stop member 144 moves vertically up and down in the direction of the arrow 170 as shown in FIG. 4, and its upper limit of movement is determined by the stop engaging surface 160. It should be noted that there is a slot 171 through the wall of the housing 124 which enables the stop 144 to extend outward into contact with the stop engaging member 154.

As shown in FIG. 5, the charger spindle 20 is initially positioned at X=0 and Y=0 with its center aligned with the scanning axis 18 on the vertical limit line 162 at the approximate midpoint of such line. In this position there is sufficient clearance space of $\frac{3}{8}$ inch between such spindles and the end surface 164 of the transfer clamp arm 42 to enable such clamp arm to pivot from the lathe axis position 44 to transfer position 40 shown in FIG. 5. It should be noted that the stop 144 is spaced 3/16 inch from the stop engaging surface 160 in its initial 0, 0 spindle position 20. In the transfer position of the clamp arms 42 such arms are moved into engagement with the ends of the log by actuating cylinders 56 after the spindles 20 have been adjusted to align the optimum yield axis of the log with the transfer position axis 40. As stated previously, this transfer position axis 40 also coincides with the scanning axis 18 in the embodiment of FIG. 5.

The charger spindles 20 are adjusted in a directionally limited manner in FIG. 5 over the shaded area 172 in a direction other than toward the transfer clamp 42. Thus, the charger spindle may be moved from position 20 to a first corner position 20' vertically downward $4\frac{3}{4}$ inches and horizontally to the left $4\frac{3}{4}$ inches in order to align the optimum yield axis of the log with the transfer position axis 40. If the position of maximum adjustment of the spindles is in a direction toward the clamp arm 42, like position 20'A shown in FIG. 5, the log is rotated by the computer for a portion of one revolution after scanning, to locate such adjustment position in area 172, such as position 20' which is 180 degrees from position 20'A.

The charger spindle 20 can also be moved to the other corner boundary positions of area 172 including a second corner position 20'' which is horizontally left $4\frac{3}{4}$ inches and vertically up $2\frac{3}{4}$ inches from position 20, and a third corner position 20''' which is $4\frac{3}{4}$ inches horizontally right and $2\frac{3}{4}$ inches vertically downward from position 20. The fourth corner position 20'''' of the charger spindle is located $4\frac{3}{4}$ inches horizontally to the right and downward vertically $4\frac{3}{4}$ inches from the position 20. As state earlier, the vertical limit line 162 is at an angle of 30 degrees with respect to the horizontal and is parallel to the bottom edge 164 of the clamp end portion 66. When the directions of maximum adjustments of the opposite ends of the log are 180 degrees apart, the log can be rotated into a position so that such adjustments are taken in opposite directions along the limit line 162 between spindle positions 20'' and 20'''. In all other cases the adjustments of the opposite ends of the log are less than 180 degrees apart so they can always be made within the adjustment area 172 after partial rotation of the log. It can be seen from FIG. 5 that the charger spindles 20 are always adjusted from the scanning axis position 18 in a direction other than toward the transfer clamp arm 42 including either away from or parallel to the end surface 164 of the clamp arm in order to maintain sufficient clearance space between such spindles and the clamp arm in all positions of the spindles. This enables the charger spindles to remain in engagement with the log while the transfer clamp arm is swung from the lathe axis position 44 to the transfer position 40. The transfer clamp arms 42 are moved into engagement with the log after the optimum yield axis of such log is adjusted into alignment with the transfer position axis 40.

Figure 6:
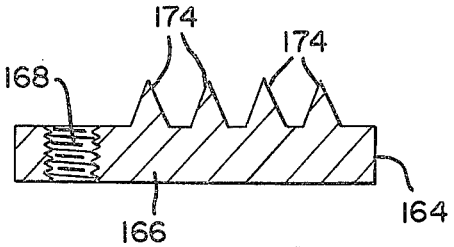
FIG. 6 is an enlarged section view taken along line 6—6 of FIG. 5.

As shown in FIG. 6, the clamp end portion 166 is provided with a plurality of arcuate gripping ridges 174 which bite into the ends of the log to hold it in place on the transfer arm as the log is carried from the transfer position to the lathe axis position.

Another embodiment of the veneer lathe charger apparatus of the present invention is shown in FIGS. 7 and 8. This second embodiment is similar to the previously described embodiment of FIGS. 1 to 6 so that the same reference numerals will be used for like elements, and only the differences between the two embodiments will be described with respect to FIGS. 7 and 8. A different rough centering means 10' is employed including an upper V-shaped jaw clamp member 176 and a lower V-shaped jaw clamp 178. The log is carried on a conveyor chain 180 which extends around an end pulley 182, and falls into the jaws of the lower V-shaped clamp 178 in its lowered position shown. The lower V-clamp 178 is raised by a hydraulic cylinder 184 and the upper V-clamp 176 is lowered by another hydraulic cylinder 186. The cylinders 184 and 186 are coupled by hydraulic lines so that their pistons move together in a conventional manner to mechanically rough center the log at the scanning axis 18. Thus, the log 11 is clamped between the jaws of the V-clamp members 176 and 178 as they are moved together and roughly centered so that its longitudinal axis is in alignment with the scanning axis 18 of the charger spindle 20. The cylinders 184 and 186 are connected together at their top ends so that the pistons of such cylinders move toward each other in a predetermined displacement ratio for a given amount of liquid pressure applied to the bottom end of the cylinder 184.

However, since the volume of cylinder 186 is less than cylinder 184, the V-clamp 176 moves a greater distance than V-clamp 178 for a given amount of fluid displacement. This causes the V-clamp members 176 and 178 to move vertically toward and away from each other in the direction of arrow 188. After the log 11 is rough centered with its longitudinal axis in alignment with the scan axis 18, the charger spindles 20 engage the opposite ends of the log and rotate the log during scanning of such log by the light beams 28 in a similar manner to that described above with respect to FIG. 1.

When the optimum yield axis of the log is determined and scanning ceased, a modified transfer clamp arm 42' is moved from the lathe axis position 44 to the transfer position adjacent the transfer axis 40 which is spaced above the scanning axis 18 by a predetermined amount of, for example, 8 inches which is sufficient to provide clearance between the bottom end of the transfer clamp arm and the charger spindle 20 during such transfer movement. The transfer clamp arms are moved inward into engagement with the opposite ends of the log by means of the cylinders 56 after the position of such log is adjusted by the spindle adjustment means 36, 38, 116, 130 to align its optimum yield axis with the transfer position axis 40 in the manner hereafter described with reference to FIG. 8. When the transfer clamp arm 42' engages the log, the charger spindles 20 are disengaged and the log is then moved from the transfer position axis 40 to the lathe axis 44 where the optimum yield axis of the log is aligned with such lathe axis. Finally, transfer arms 42' disengage after the lathe spindles engage the ends of the log at position 44 and peeling of the log to produce wood veneer begins.

Each modified transfer clamp arm 42' is mounted on a wheeled carriage 190 which rides on a pair of spaced track rails 192 above the charger spindles at each end of the log. The carriage is driven along the track by two cables 194 and 196 which are both attached to fixed anchor members 200 and 202, respectively. The cable 194 passes over a first pulley 204 at the left end of the track and over a second smaller pulley 206 of about ½ its diameter, attached to one end of a operating piston 208, and is fixed to an anchor 200. Similarly, cable 196 passes over a pulley 210 at the right end of the track and around a second smaller pulley 212 of about ½ its diameter, attached to the end of the piston rod of cylinder 208, and is fixed to anchor 202. As a result of the mechanical advantage of the pulleys, movement through a distance X by the piston rod of cylinder 208 causes a greater movement 2X by the transfer carriage 190 which is approximately twice as long. The maximum displacement of the piston of cylinder 208 is set to be of the proper amount to move the carriage and transfer clamp arm 42' the correct distance between the transfer axis position 40 and the lathe axis 44. However, adjustable stops 214 are provided at the opposite ends of the track to insure the transfer clamp arm 42' with the transfer position axis 40 and the lathe axis 44.

While it is not necessary, the transfer clamp arm 42' may be of a telescoping tube type including an inner tube 216 and outer tube 218. A cylinder 220 pivotally attached at one end to the outer tube 218 and having its piston rod pivotally attached to a flange 222 on the inner tube 216, is employed to change the length of the transfer clamp arm 42'. It should be noted that because of the predetermined spacing between the scanning axis 18 and the transfer position axis 40, it is not necessary for the transfer clamp arm to be adjustable in length for clearance purposes. However, the telescoping arm can be varied in length for other reasons such as when the spacing between the scanning axis 18 and the transfer position axis 40 is changed to horizontally align the transfer axis with the lathe axis 44.

A discharge conveyor 224 is employed between the charger spindles 20 and the lathe axis 44 in order to discharge any defective logs or peeled cores. The discharge conveyor removes the logs by moving them longitudinally out of the apparatus.

The operation of the charger spindle support adjustment means used in the embodiment of FIG. 7, is shown diagrammatically in FIG. 8. The reference charger spindle position 20 at X=0 and Y=0 is shown in solid lines with its center aligned with the transfer position axis 40 which is spaced vertically upward 8 inches above the scan axis 18 and horizontally aligned with such scan axis. This condition would only exist when the optimum yield axis of the log corresponds exactly to the rough centered axis at the scan position 18. In most cases, the position of the charger spindle 20 is adjusted to a different location anywhere within the adjustment area 172'. The adjustment area is bounded by four corner boundary positions including a first corner position 20' whose center is spaced 8 inches below and 3 inches to the right of the transfer axis 40. A second corner boundary position 20'' of the charger spindle is spaced 3 inches to the right and 1½ inches above the transfer axis 40. A third corner boundary position 20'''' is positioned 8 inches below and 1½ inches above the transfer axis 40. A third corner boundary position 20''' is spaced 1.22 inches to the left and 1.22 inches above the transfer axis 40. The fourth corner boundary position 20'''' is positioned 8 inches below and 1½ inches to the left of the transfer axis 40.

The lathe spindles 20 can be adjusted and the opposite ends of the log moved into any spindle center position within the adjustment area 172' of FIG. 8 in order to position the optimum yield axis of a log in alignment with the transfer position axis 40. To accomplish this, the log may have to be rotated for a portion of one complete revolution after scanning in order to change the direction of maximum adjustment of the charger spindle 20 into the adjustment area 172'. For example, a spindle position 20'A of maximum adjustment from the reference position 20, is outside the adjustment area 172' in a direction toward the transfer clamp arm 42' so that it cannot be made. However such maximum adjustment position can be moved to position 20' inside the adjustment area merely by rotating the log 180 degrees. The same thing is true in the embodiment of FIG. 5 as described above. In both embodiments the computer is programmed to rotate the log a portion of one revolution after scanning in order to orient the position of maximum adjustment of the charger spindle into the adjustment area 172 or 172'.

The adjustment area 172' in the embodiment of FIG. 8 covers approximately a 90 degree quadrant measured about the axis of the charger spindle in the upper left corner position 20'''. In this position the charger spindle is spaced from the bottom edge 164' of the clamp portion 66' by $\frac{3}{8}$ inch clearance. A similar clearance is provided in the position 20'' of the charger spindle. It should be noted that the charger spindle 20 can be moved a maximum of $1\frac{1}{2}$ inches toward the clamp arm end portion 166', but can move away from such clamp arm a much greater amount between 3 inches and 8 inches away from such arm. Thus, the adjustment range of the charger spindle toward the clamp arm is much less than the adjustment range of such spindle away from such clamp arm since the latter range is at least twice as great as the former range. This directionally limited adjustment of the charger spindle in the transfer position in both the embodiments of FIGS. 5 and 8 enables a greater adjustment range while also providing sufficient clearance for the transfer clamp arms to engage the ends of the log while it is still held by the charger spindles, thereby eliminating any need for reclamping by the rough centering means prior to engagement by the transfer clamp arms.

It will be obvious to those having ordinary skill in the art that many changes may be made in the above described preferred embodiments of the present invention without departing from the spirit of the invention. For example, other rough centering mechanisms and different transfer clamp arms can be employed different from those shown. Therefore, the scope of the present invention should only be determined by the following claims.

I claim:

1. Log processing apparatus, comprising:

log support and centering means for supporting and positioning a log with its axis roughly centered at a scan axis position;

charger spindle means for engaging the ends of the log after rough centering and for rotating said log about a spindle axis;

scanning means for scanning the log with electromagnetic radiation as said log is rotated in said scan axis position by said charger spindle means, to determine the optimum yield axis of the log for optimum wood production;

clamp means for engaging the ends of the log while said charger spindle means still engages said log after the log is moved by the charger spindle means to a transfer position;

spindle support and adjustment means for adjusting the position of the charger spindle means and being capable of moving said spindle means away from said clamp means a greater distance than toward said clamp means;

control means for causing the charger spindle means to rotate the log to a different rotational position after scanning to enable the spindle support and adjustment means to move the log through its greatest adjustment in a direction other than toward the clamp means;

said support and adjustment means being controlled by said control means to move the charger spindle means to a transfer position where the log has its optimum yield axis located at a predetermined position relative to a work axis; and transfer means for moving said clamp means after it engages the ends of the log in said transfer position and the charger spindle means is disengaged, to transfer the log from said transfer position to a work position where the log is cut when the optimum axis of the log is aligned with the work axis.

2. Apparatus in accordance with claim 1 in which the spindle support and adjustment means adjusts the charger spindle means in two mutually perpendicular directions.

3. Apparatus in accordance with claim 1 in which the transfer means includes a wheeled carriage means for moving the clamp means between said transfer position and said work position.

4. Apparatus in accordance with claim 3 in which said clamp means includes telescopic support arms attached to the carriage means.

5. Apparatus in accordance with claim 1 in which the transfer means includes cylinder means for pivoting clamp arm means between said transfer position and said work position.

6. Apparatus in accordance with claim 1 in which the scan position is spaced from said transfer position by an amount sufficient to enable the clamp means to clear the charger spindle means in said scan position, when said transfer means moves the clamp means from said work position to said transfer position.

7. Apparatus in accordance with claim 1 in which the scanning means scans the log with light to determine its optimum yield axis.

8. Apparatus in accordance with claim 6 in which the clamp means has a clamp end portion with an arcuate shape which partially surrounds the charger spindle in said transfer position, and the control means causes the spindle support and adjustment means to limit movement of the charger spindle means to an angular range of about 90 degrees relative to the transfer position axis.

9. Apparatus in accordance with claim 1 in which the spindle support and adjustment means can move the charger spindle means away from the clamp means at least twice the distance it can move toward said clamp means in said transfer position.

10. Apparatus in accordance with claim 1 including a stop means for preventing the spindle support and adjustment means from moving the charger spindle means toward said clamp means when said spindle means is moved to said transfer position.

11. Apparatus in accordance with claim 1 in which the control means causes the spindle support and adjustment means to limit the movement of the charger spindle means to a maximum angular range of about 180 degrees relative to the transfer position axis.

12. Veneer lathe charger apparatus, comprising:

log support and centering means for supporting and positioning a log with its axis roughly centered at a scan position;

charger spindle means for engaging the ends of the log after rough centering and for rotating said log about a spindle axis;

scanning means for scanning the log with a light beam during rotation by said charger spindle means, to determine the optimum yield axis of the log for optimum wood veneer production;

clamp means for engaging the ends of the log while said charger spindle means still engages said log after the log is moved by the charger spindle means to a transfer position;

spindle support and adjustment means for adjusting the position of the charger spindle means and being capable of moving said spindle means away from said clamp means a greater distance than toward said clamp means;

control means for causing said support and adjustment means to move the charger spindle means so that the log is positioned with its optimum yield axis at a transfer position which is located at a predetermined position relative to a lathe spindle axis position; and transfer means for moving the clamp means to transfer the log from said transfer position to the lathe spindle position after disengaging the charger spindle means.

13. Apparatus in accordance with claim 12 in which the control means causes the charger spindle means to rotate the log to a different rotational position after scanning to enable the spindle support and adjustment means to move the log through its greatest adjustment in a direction other than toward the clamp means.

14. Apparatus in accordance with claim 12 in which the spindle support and adjustment means adjusts the charger spindle means in two mutually perpendicular directions.

15. Apparatus in accordance with claim 12 in which the scan position is spaced from said transfer position by an amount sufficient to enable the clamp means to clear the charger spindle means in said scan position, when said transfer means moves the clamp means from said lathe spindle position to said transfer position.

16. Apparatus in accordance with claim 15 in which the clamp means has a clamp end portion with an arcuate shape which partially surrounds the charger spindle in said transfer position, and the control means causes the spindle support and adjustment means to limit movement of the charger spindle means to an angular range of about 90 degrees relative to the transfer position axis.

17. Apparatus in accordance with claim 12 including a stop means for preventing the spindle support and adjustment means from moving the charger spindle means toward said clamp means when said spindle means is moved to said transfer position.

18. Apparatus in accordance with claim 12 in which the control means causes the spindle support and adjustment means to limit movement of the charger spindle to an angular range of about 180 degrees or less relative to the transfer position axis.

* * * * *